US006890057B2

(12) United States Patent
Gotoh et al.

(10) Patent No.: US 6,890,057 B2
(45) Date of Patent: May 10, 2005

(54) INKJET PRINTER WASTE INK STORAGE APPARATUS

(75) Inventors: Takashi Gotoh, Nara (JP); Hisashi Yoshimura, Nara (JP); Naozumi Ueno, Ikoma (JP); Tomomi Tanaka, Ikoma (JP); Masaki Matsushita, Nara (JP); Hirokazu Nakamura, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/609,526

(22) Filed: Jul. 1, 2003

(65) Prior Publication Data

US 2005/0001874 A1 Jan. 6, 2005

(30) Foreign Application Priority Data

Jul. 1, 2003 (JP) ..... 2002-192306

(51) Int. Cl.[7] ..... B41J 2/165

(52) U.S. Cl. ..... 347/36; 347/31; 347/35

(58) Field of Search ..... 347/22, 24, 29, 347/30, 32, 31, 36

(56) References Cited

U.S. PATENT DOCUMENTS 5,113,206 A * 5/1992 Fukazawa ..... 347/86
6,659,587 B2 * 12/2003 Berg et al. ..... 347/36

FOREIGN PATENT DOCUMENTS

| | | |
|---|---|---|
| JP | 7-89084 A | 4/1995 |
| JP | 9-76530 A | 3/1997 |
| JP | 2000-141705 A | 5/2000 |
| JP | 2000-168107 A | 6/2000 |

* cited by examiner

*Primary Examiner*—Shih-Wen Hsieh
(74) *Attorney, Agent, or Firm*—Birch, Stewart, Kolasch & Birch, LLP

(57) ABSTRACT

Ink absorption pads are associated with waste ink storage apparatus in ink jet printers. Waste ink is emitted from the tubes. The waste ink is absorbed by the pads.

13 Claims, 9 Drawing Sheets

INKJET PRINTER WASTE INK STORAGE APPARATUS

BACKGROUND OF INVENTION

1. Field of Invention

The present invention pertains to a waste ink storage apparatus for storing waste ink in the context of inkjet printer(s), and more specifically pertains to a waste ink storage apparatus permitting waste ink from waste ink tube(s) to be absorbed by waste ink absorption pad(s).

2. Conventional Art

Inkjet printer waste ink storage apparatuses designed to cause waste ink to be efficiently absorbed by waste ink absorption pads have existed conventionally. For example, with the electronic equipment disclosed at Japanese Patent Application Publication Kokai No. 2000-168107, waste ink sucked from a recording head during recording head maintenance or the like is caused to be directly absorbed onto a waste ink absorption pad from a discharge orifice. In this constitution, the waste ink discharge orifice and waste ink absorption pad are brought into intimate contact as a result of attaching this waste ink container in inclined fashion.

Furthermore, other waste ink storage apparatuses include those provided with an inclined guide wall that guides waste ink to a waste ink absorption pad, such as is disclosed at Japanese Patent Application Publication Kokai No. H7-89084 (1995); and here as well, waste ink from a waste ink tube is caused to be rapidly absorbed by a waste ink absorption pad.

Moreover, other waste ink storage apparatuses include those such as is disclosed at Japanese Patent Application Publication Kokai No. 2000-141705 wherein the layers of a multilayer waste ink absorption pad are respectively provided with through-holes, rapid penetration down to the bottom layer of the waste ink absorption pad being achieved as a result of the fact that respective waste ink absorption pad layers are laminated in mutually staggered fashion to form layers wherein a portion of the through-holes thereof are in communication with one another so as to permit waste ink from a waste ink tube to flow down the staircase-like layers of the waste ink absorption pad.

However, the foregoing conventional apparatuses have problems such as the following.

First, where the waste ink container is attached in inclined fashion, because the waste ink absorption pad on the waste ink container bottom is in intimate contact with the tip of the waste ink tube, area over which initiation of absorption by the waste ink absorption pad of waste ink from the waste ink tube occurs will be extremely small and limited.

Furthermore, where an inclined guide wall that guides waste ink to a waste ink absorption pad is provided, because waste ink from the waste ink tube is first made to collide with the guide wall before being guided to the waste ink absorption pad, waste ink is made to splash when it collides with the guide wall.

Moreover, where waste ink absorption pad layers are laminated in staggered fashion such that a portion of the respective through-holes are in communication with one another, while a portion of the through-holes are in communication, promoting propagation of waste ink, area over which initiation of absorption by the waste ink absorption pad of waste ink from the waste ink tube occurs will be small.

Now, when waste ink drips onto a waste ink absorption pad on a waste ink container bottom, waste ink diffuses outward from the location on the waste ink absorption pad onto which the waste ink drips, absorption of waste ink proceeding with the location on the waste ink absorption pad which is nearest to the location of the dripping ink serving as waste ink absorption center. Moreover, waste ink absorbed into the interior of the waste ink absorption pad propagates through the waste ink absorption pad interior, diffusion also occurring at the interior of the waste ink absorption pad. However, as discharge of waste ink continues, and dripping of waste ink continues to be concentrated at the waste ink absorption center, the rate at which waste ink propagates through the interior of the waste ink absorption pad slows, and the rate at which waste ink is absorbed at the waste ink absorption center slows. This being the case, if the rate at which waste ink is absorbed at the waste ink absorption center drops below the rate at which waste ink is discharged (the rate at which ink is dripping), discharged waste ink may be carried along the ink container bottom, moving from the original waste ink absorption center to a new waste ink absorption center At such time, it being the case that waste ink must necessarily pass through the original waste ink absorption center before it can be absorbed into the interior of the waste ink absorption pad, the original waste ink absorption center will not absorb waste ink but will nonetheless be wetted by waste ink until the discharged waste ink is absorbed by the new waste ink absorption center. In such cases, depending upon the properties of the waste ink, waste ink may increase in viscosity and block fluid paths traveled by waste ink near the original waste ink absorption center or may stick to the waste ink absorption pad and interfere with absorption of waste ink.

Due to occurrence of such phenomena, with the aforementioned conventional apparatus in which waste ink container attached in inclined fashion, because the waste ink absorption pad on the waste ink container bottom is in intimate contact with the tip of the waste ink tube, area over which initiation of absorption by the waste ink absorption pad of waste ink from the waste ink tube occurs will be extremely small and limited, in which case blocking of fluid paths traveled by waste ink near the original waste ink absorption center and sticking of waste ink will tend to occur as described above, preventing waste ink from the waste ink tube from being efficiently absorbed by the waste ink absorption pad.

Furthermore, with the aforementioned conventional apparatus in which an inclined guide wall that guides waste ink is provided, because waste ink from the waste ink tube is first made to collide with the guide wall before being guided to the waste ink absorption pad, while blocking of fluid paths traveled by waste ink near the original waste ink absorption center and sticking of waste ink do not tend to occur, waste ink is nonetheless made to splash when it collides with the guide wall, preventing waste ink from the waste ink tube from being efficiently absorbed by the waste ink absorption pad.

Moreover, where waste ink absorption pad layers are laminated in staggered fashion such that a portion of the respective through-holes are in communication with one another, while a portion of the through-holes are in communication, promoting propagation of waste ink, it is still the case that area over which initiation of absorption by the waste ink absorption pad of waste ink from the waste ink tube occurs is small, and waste ink from the waste ink tube is for similar reasons prevented from being efficiently absorbed by the waste ink absorption pad.

SUMMARY OF INVENTION

The present invention was conceived in light of such points, it being an object thereof to provide an inkjet printer waste ink storage apparatus capable of increasing area over which initiation of absorption of waste ink by waste ink absorption pad(s) can occur and permitting waste ink from waste ink tube(s) to be efficiently absorbed by waste ink absorption pad(s).

In order to achieve the foregoing object and/or other objects, an embodiment of the inkjet printer waste ink storage apparatus of the present invention, in the context of an inkjet printer waste ink storage apparatus equipped with one or more waste ink containers, at least one of the bottom or bottoms of which is capable of receiving waste ink dripping by way of one or more waste ink tubes from one or more recording heads; and one or more waste ink absorption pads, at least one of which is capable of absorbing and storing at least a portion of the waste ink received by at least one of the bottom or bottoms of at least one of the waste ink container or containers, is characterized in that it is provided with one or more bosses at one or more drip regions where at least a portion of the waste ink drips into at least one of the bottom or bottoms of at least one of the waste ink container or containers.

Such constitution makes it possible for waste ink dripping onto boss(es) from tip(s) of waste ink tube(s) to, as it is dispersed in all directions at boss(es), be carried along boss surface(s) and reach respective waste ink container bottom (s) (low point(s)), allowing it to be absorbed by waste ink absorption pad(s) in well-balanced fashion. This therefore permits area over which initiation of absorption by waste ink absorption pad(s) of waste ink from waste ink tube(s) can occur to be made extremely large due to presence of waste ink which reaches respective waste ink container bottom(s) as it is dispersed in all directions at boss(es). As a result, blocking of fluid path(s) traveled by waste ink near original waste ink absorption center(s) and sticking of waste ink do not tend to occur, making it possible for waste ink from waste ink tube(s) to be efficiently absorbed by waste ink absorption pad(s). Not only that, but it is also the case that because waste ink dripping onto boss(es) and being dispersed in all directions is carried along boss surface(s) to reach waste ink container bottom(s), waste ink does not splash as is the case in conventional constitutions where waste ink is made to collide with guide wall(s), and waste ink is definitively absorbed by waste ink absorption pad(s).

In such constitution, the cross-section of at least one of the boss or bosses may be formed so as to be more or less arcuate in shape. In accordance with such constitution, boss(es) is or are such that slope(s) of face(s) thereof grow steeper relative to waste ink container bottom(s) with increasing proximity to the periphery or peripheries thereof, i.e., with increasing proximity to waste ink container bottom (s). Waste ink dripping onto boss(es) therefore does not linger at sloped face(s) of boss(es), but is carried along boss surface(s) to reach waste ink container bottom(s), permitting waste ink to be definitively absorbed by waste ink absorption pad(s).

Furthermore, at least one of the waste ink absorption pad or pads may be disposed at a location preventing it from coming into direct contact with at least one of the boss or bosses and preventing it from coming into direct contact with the waste ink droplet or droplets dripping onto at least one of the boss or bosses. In accordance with such constitution, because boss(es) do not contact waste ink absorption pad(s), waste ink carried along boss(es) and reaching waste ink container bottom(s) diffuses toward waste ink absorption pad(s), allowing waste ink to be absorbed by waste ink absorption pad(s) in well-balanced fashion, waste ink not being absorbed with occurrence of bias(es) with respect to waste ink absorption pad(s) such as would be the case if boss(es) contacted waste ink absorption pad(s).

Moreover, the constitution may be such that at least one of the boss or bosses has at least one curved surface at at least one basal portion thereof making it smoothly continuous with at least one of the bottom or bottoms of at least one of the waste ink container or containers. In accordance with such constitution, due to presence of curved surface(s) at basal portion(s) of boss(es), waste ink carried along boss(es) flows without lingering at basal portion(s) of boss(es) as it diffuses toward waste ink absorption pad(s) from waste ink container bottom(s). This makes it possible for waste ink from waste ink tube(s) to be efficiently absorbed by waste ink absorption pad(s).

Moreover, the constitution may be such that at least one of the waste ink absorption pad or pads is disposed over at least one of the bottom or bottoms of at least one of the waste ink container or containers and is provided with one or more through-holes permitting waste ink to drip from at least one of the waste ink tube or tubes onto at least one of the bottom or bottoms of at least one of the waste ink container or containers; and the inside diameter of at least one of the through-hole or -holes is greater than the outside diameter of at least one of the waste ink tube or tubes.

In accordance with such constitution, due to presence of waste ink absorption pad through-hole(s) larger than outside diameter(s) of waste ink tube(s), waste ink from tip region(s) of waste ink tube(s) drips directly onto boss(es), and as it is dispersed in all directions at boss(es), it is carried along boss surface(s) and reaches waste ink container bottom(s) (low point(s)), whereupon it diffuses and is absorbed in well-balanced fashion from area(s) surrounding waste ink absorption pad through-hole(s).

Furthermore, at least one of the bottom or bottoms of at least one of the waste ink container or containers may present at least one curved surface which is convex as viewed from above.

In accordance with such constitution, waste ink dripping onto boss(es) does not linger at sloped face(s) of boss(es), but is carried along boss surface(s) to reach waste ink container bottom(s), whereupon it follows the shape(s) of such bottom(s) and is proactively diffused toward peripheral end(s) of waste ink absorption pad(s), permitting waste ink to be efficiently absorbed by waste ink absorption pad(s). Moreover, this also makes it possible to facilitate propagation of waste ink absorbed by waste ink absorption pad(s) to peripheral end(s) of waste ink absorption pad(s), increasing efficiency with which waste ink is absorbed by waste ink absorption pad(s).

Alternatively or in addition thereto, the inkjet printer waste ink storage apparatus, in the context of an inkjet printer waste ink storage apparatus equipped with one or more waste ink containers, at least one of the bottom or bottoms of which is capable of receiving waste ink dripping by way of one or more waste ink tubes from one or more recording heads; and one or more waste ink absorption pads, at least one of which is capable of absorbing and storing at least a portion of the waste ink received by at least one of the bottom or bottoms of at least one of the waste ink container or containers, may have a constitution characterized in that at least one bottom of at least one waste ink container presents at least one curved surface which is convex as viewed from above; at least one waste ink absorption pad is provided with one or more through-holes permitting waste ink to drip from at least one of the waste ink tube or tubes onto at least one of the bottom or bottoms of at least one of the waste ink container or containers; and at least one region occupied by at least one of the curved surface or surfaces of at least one of the waste ink container bottom or bottoms is larger than at least one of the through-hole or -holes in the waste ink absorption pad or pads.

Such constitution makes it possible for waste ink dripping onto waste ink container bottom(s) to, as it follows shape(s) of curved surface(s) of bottom(s) and is diffused after being dispersed in all directions, be absorbed in well-balanced fashion from area(s) surrounding waste ink absorption pad through-hole(s) and, due to shape(s) of curved surface(s) of bottom(s), to not accumulate at area(s) surrounding waste ink absorption pad through-hole(s) but to propagate to peripheral end(s) of waste ink absorption pad(s), increasing efficiency with which waste ink is absorbed by waste ink absorption pad(s).

In addition, at least one bottom of at least one waste ink container may be provided with one or more channels extending radially from one or more central locations onto which waste ink drips. In accordance with such constitution, waste ink dripping into waste ink container(s) and dispersed in all directions is carried along respective channel(s) and is diffused, surface tension causing absorption by waste ink absorption pad(s) to occur over a domain which is large in size. In this way, distribution of absorption location(s) on waste ink absorption pad(s) occurs in definitive fashion due to presence of waste ink which is carried along channel(s) and is diffused, making it possible for waste ink to be absorbed by waste ink absorption pad(s) in still more well-balanced fashion.

In such constitution, at least one of the bottom or bottoms of at least one of the waste ink container or containers may be provided with one or more circumferential channels making mutually continuous, in one or more circumferential directions around at least one of the central location or locations onto which waste ink drips, at least a portion of the channel or channels extending radially. In accordance with such constitution, even if waste ink which is being carried along channel(s) and is being diffused were to solidify while traveling through a channel, new waste ink carried along that channel and being diffused thereto would be carried along circumferential channel(s) and be guided to neighboring channel(s), this making it possible to maintain the efficiency with which waste ink is absorbed by waste ink absorption pad(s) in versatile fashion.

Alternatively or in addition thereto, at least one bottom of at least one waste ink container may be provided with one or more ribs extending radially from one or more central locations onto which waste ink drips. In accordance with such constitution, waste ink dripping into waste ink container(s) and being dispersed in all directions is carried along vertical face(s) of rib(s), surface tension causing absorption by waste ink absorption pad(s) to occur over a domain which is large in size. In this way, distribution of absorption location(s) on waste ink absorption pad(s) occurs in definitive fashion due to the fact that waste ink is carried along vertical face(s) of rib(s) and is diffused, making it possible for waste ink to be absorbed by waste ink absorption pad(s) in still more well-balanced fashion.

In such case, at least one bottom of at least one waste ink container may be provided with one or more circumferential channels passing through, in one or more circumferential directions around at least one of the central location or locations onto which waste ink drips, at least a portion of the rib or ribs extending radially. In accordance with such constitution, even if waste ink which is being carried along vertical face(s) of respective rib(s) and is being diffused were to solidify while traveling along a vertical face, new waste ink carried along that rib vertical face and being diffused thereto would be carried along circumferential channel(s) and be guided to vertical face(s) of neighboring rib(s), this making it possible to maintain the efficiency with which waste ink is absorbed by waste ink absorption pad(s) in versatile fashion.

Moreover, at least one tip of at least one of the waste ink tube or tubes may be located within at least one of the through-hole or -holes in at least one of the waste ink absorption pad or pads. In accordance with such constitution, even where bubble(s) produced when air drawn together with waste ink drawn from recording head(s) is discharged from end(s) of waste ink tube(s) together with waste ink burst at waste ink tube tip(s), atomizing waste ink and spraying it about, waste ink spray is captured within waste ink absorption pad through-hole(s) and is absorbed by waste ink absorption pad(s), making it possible for waste ink to be definitively absorbed by waste ink absorption pad(s) without dirtying surrounding area(s).

DESCRIPTION OF PREFERRED EMBODIMENTS

Below, embodiments of the present invention are described with reference to the drawings.

First Embodiment

Figure 1:
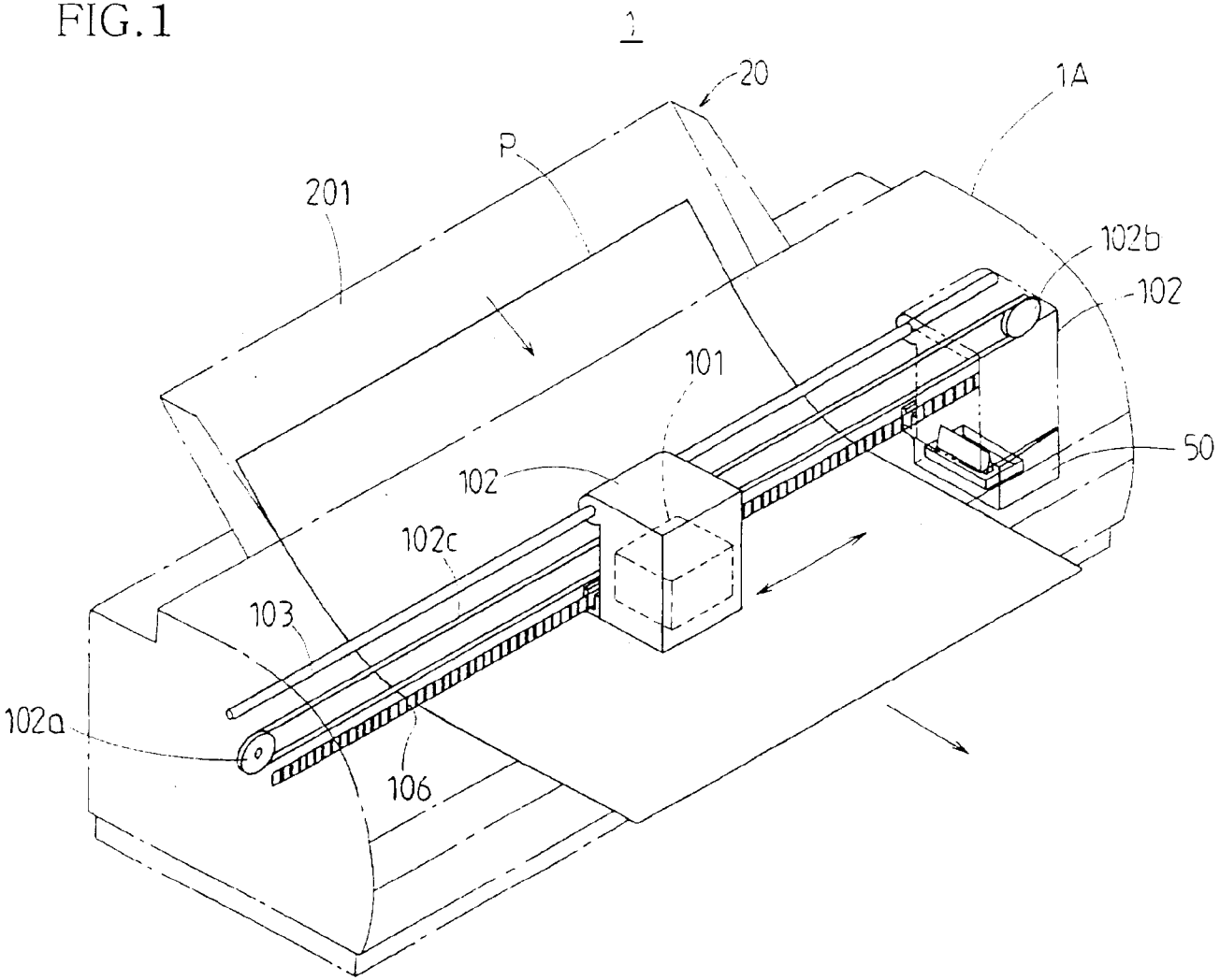
FIG. 1 is an oblique view showing the showing the internal constitution of a color inkjet printer associated with a first embodiment of the present invention.
Figure 2:
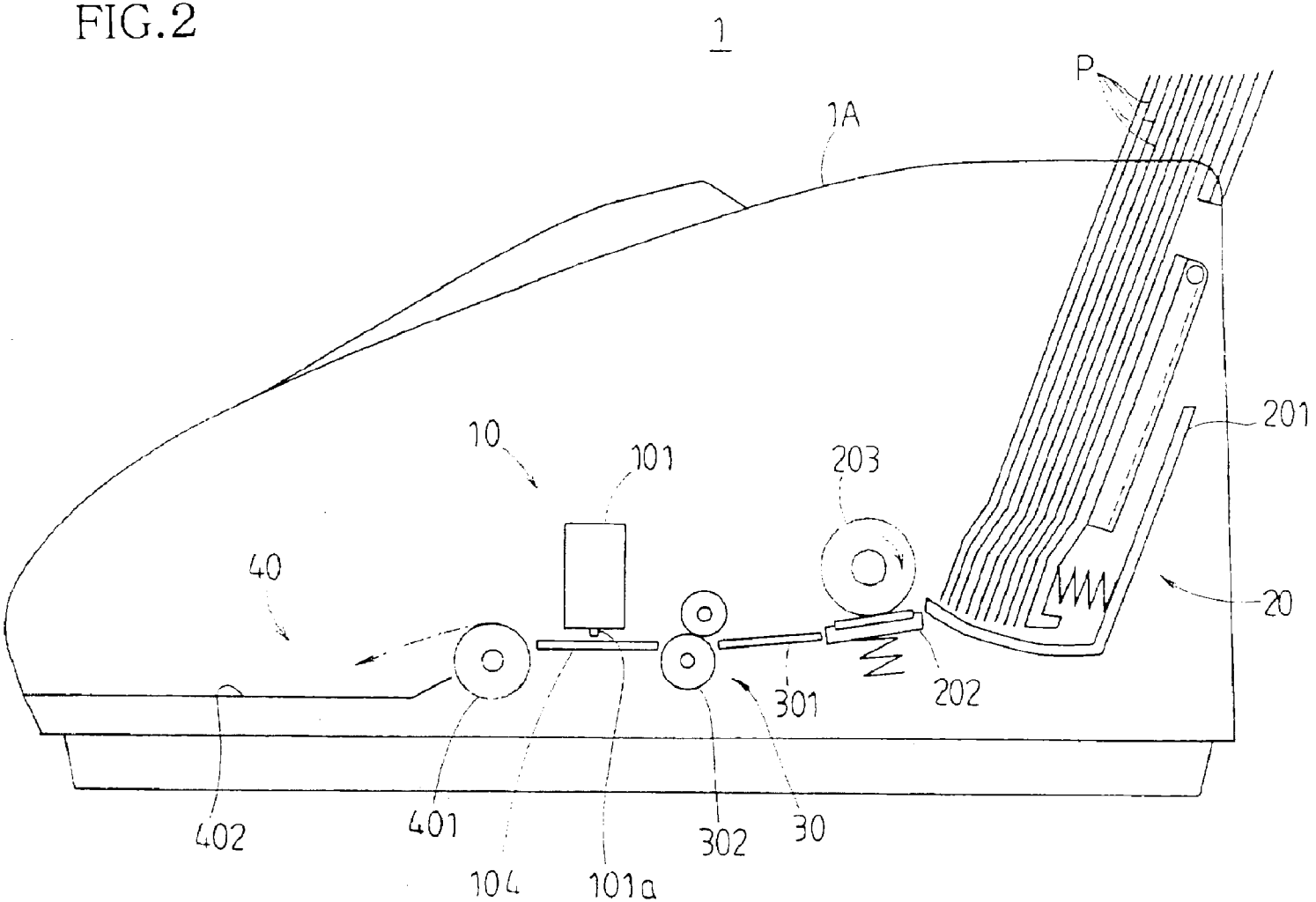
FIG. 2 is a sectional view showing the internal constitution of a color inkjet printer therein.

FIGS. 1 and 2 are illustrative drawings showing the constitution of a color inkjet printer associated with the present embodiment.

At FIGS. 1 and 2, color inkjet printer 1, being an image forming apparatus wherein images are formed by jetting of ink onto recording paper P, is equipped with image forming unit(s) 10 capable of forming images on recording paper P; media supply unit(s) 20 capable of supplying recording paper P to color inkjet printer main body or bodies 1A; transport unit(s) 30 capable of transporting recording paper P from media supply unit(s) 20 to image forming unit(s) 10; and discharge unit(s) 40 capable of discharging recording paper P on which images have been formed by image forming unit(s) 10. The foregoing media supply unit 20 is equipped with media supply tray(s) 201, separator plate(s) 202, and supply roller(s) 203. Media supply tray 201 stores and supplies recording paper P for image formation. Separator plate(s) 202 and supply roller(s) 203 cause recording paper P which is stored in media supply tray(s) 201 to be separated one sheet at a time and to be supplied to transport unit(s) 30.

Transport unit 30 is equipped with guide plate(s) 301 and transport roller(s) 302. The foregoing guide plate 301 is for guiding recording paper P supplied thereto from supply roller(s) 203 to image forming unit(s) 10. The foregoing transport roller 302 is constituted so as to be capable of causing recording paper P passing over guide plate 301 to be transported to image forming head 101, described below.

Figure 3:
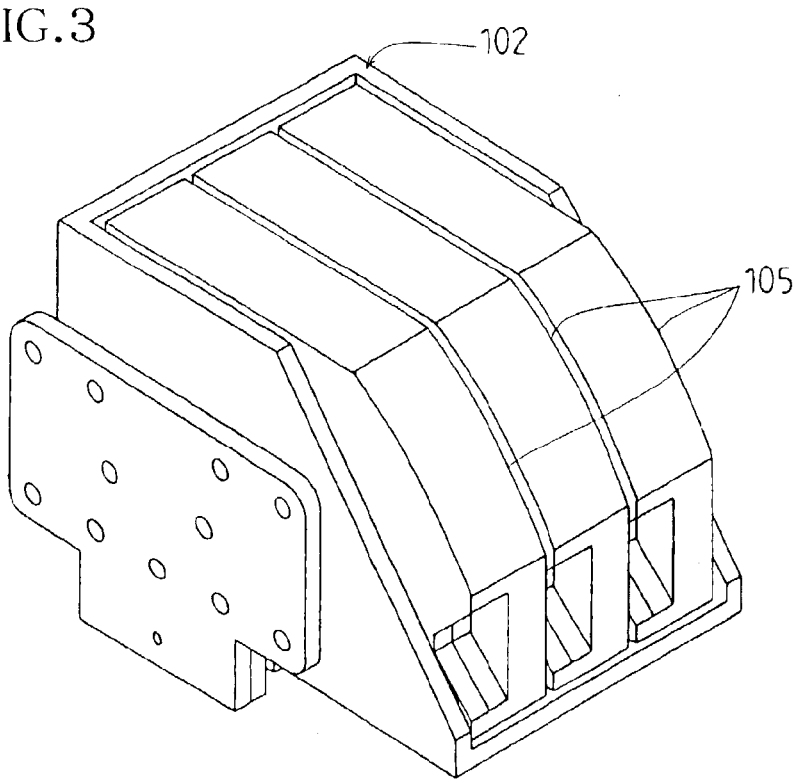
FIG. 3 is an oblique view of an ink carriage therein.

The foregoing image forming unit 10 is equipped with ink carriage(s) 102, shaft(s) 103 (see FIG. 1), and platen(s) 104 (see FIG. 2). Ink carriage 102 is drivably linked to DC motor(s), not shown. More specifically, ink carriage 102 is secured in the approach path of belt 102*c*, belt 102*c* being suspended between drive pulley 102*a* and idler pulley 102*b*, drive pulley 102*a* being linked to the output shaft of a DC motor so as to rotate in integral fashion therewith, such that ink carriage 102 is made to move in reciprocating fashion parallel to guide shaft 103, to the left and right (scan direction) in FIG. 1, in accompaniment to driving by the DC motor. Furthermore, the foregoing ink carriage 102 is equipped with three ink cartridges 105, . . . , 105 as shown in FIG. 3 and image forming head(s) (recording head(s)) 101. Each such ink cartridge 105 is capable of storing ink, is capable of supplying ink to image forming head 101, and is attached to image forming head 101 at the upper portion thereof. Furthermore, as the present color inkjet printer 1 employs ink of three mutually different colors (yellow, magenta, and cyan), it is equipped with three ink cartridges 105 for storing the respective inks. Ink supplied thereto from ink cartridge(s) 105 is jetted by the foregoing image forming head 101 from jet orifice(s) 101*a* to form images on recording paper P. The foregoing guide shaft 103 is a guide for guiding ink carriage 102 such that it is capable of moving in the scan direction. In addition, provided below the foregoing guide shaft 103 there is or are encoder strip(s) 106 extending in the scan direction and parallel to that guide shaft 103. Present on this encoder strip 106 are markings which are spaced apart with uniform pitch in the long direction thereof. Moreover, attached to the foregoing ink carriage 102 there is or are sensor(s) (not shown) for detecting the markings on the foregoing encoder strip 106. In addition, controller(s), not shown, determine distance(s) moved by and/or speed(s) of movement of ink carriage(s) 102 based on numerical count(s) and/or time interval(s) in detection signal(s) from the foregoing sensor(s), based on which controller(s) control driving of the foregoing DC motor(s) so as to cause ink carriage(s) 102 to move prescribed distance(s) at prescribed speed(s). Here, the scan direction signifies a direction perpendicular to the direction of transport of recording paper P.

During image formation (jetting of ink), the foregoing platen 104 serves as stage (stage for printing) for holding recording paper P, maintaining flatness at recording paper P and accomplishing adjustment of distance(s) between jet orifice(s) 101*a* and recording paper P.

The foregoing discharge unit 40 is equipped with discharge roller(s) 401 and discharge tray(s) 402. Discharge roller 401 is constituted so as to discharge recording paper P, on which image(s) have been formed by image forming head(s) 101, into discharge tray(s) 402.

Printing operations at the present color inkjet printer 1 are next described.

First, a user places recording paper P in media supply tray 201. In addition, the present color inkjet printer 1, upon receiving an image formation request from a computer or the like, uses separator plate 202 and supply roller 203 to supply recording paper P to transport unit 30 one sheet at a time. Recording paper P, having been supplied in this fashion, is transported by transport roller 302 while being supported by guide plate 301.

In addition, after recording paper P is transported to image forming unit 10, ink is jetted from image forming head 101 to form images on recording paper P. Such image formation is carried out as a result of causing ink carriage 102, which is provided with image forming head 101, to move in the scan direction parallel to shaft 103. That is, during image formation, ink carriage 102 is disposed at a start location provided at one end (the right end in FIG. 1) in the scan direction. In addition, in correspondence to image formation request(s), ink carriage 102 is made to move in the scan direction until it reaches a stop location provided at the other end (the left end in FIG. 1). In addition, during such movement, image forming head 101 jets ink onto recording paper P in correspondence to image formation request(s). This permits formation of one pass worth of image (one image pass) by image forming head 101. Note that the width of one image pass corresponds to the vertical dimension of image forming head 101 (the dimension thereof in the direction of transport of recording paper P). Furthermore, following formation of one pass worth of image, transport roller 302 advances recording paper P on platen 104 by an amount corresponding to the width of one image pass. Furthermore, ink carriage 102 returns to the start location while recording paper P is being advanced. In addition, by repeatedly carrying out such image formation scanning, it is possible in the present color inkjet printer 1 for image forming head 101 to form images on recording paper P of information corresponding to image formation request(s).

Finally, recording paper P, on which images have been formed, is discharged into discharge tray 402 by way of discharge roller 401 and is made available to the user in the form of document(s) (media on which image(s) have been formed).

In addition, provided at one end in the scan direction of ink carriage 102 is maintenance unit 50 capable of performing maintenance operations on image forming head 101. Because ink droplets at jet orifice(s) 101*a* at the front end (ink nozzle(s)) of image forming head 101 may dry and coagulate when image forming operations enter a stopped and/or suspended state, this maintenance unit 50 permits cleaning of image forming head 101 where it has entered a stopped state, and/or permits flushing of image forming head 101 where it has entered a suspended state (several seconds or more). For this reason, when image forming operations have been stopped and/or suspended, ink carriage 102 is driven so as to cause image forming head 101 to come to face maintenance unit 50 as indicated by the double-dash chain line in FIG. 1.

The foregoing maintenance unit 50 is equipped with head cap(s) (not shown) situated in opposing fashion with respect to image forming head 101 so as to permit waste ink to be received thereby; cap moving mechanism(s) (not shown) capable of causing such head cap(s) to move forward and backward; waste ink storage component(s) 501 (see FIG. 4) representing waste ink storage apparatus(es) capable of storing recovered waste ink; waste ink tube(s) 101*b* (see FIG. 4), one end of which is connected to head cap(s), and which extend to waste ink storage component(s) 501; and waste ink pump(s) (not shown) disposed at intervening location(s) partway along waste ink tube(s) 101*b*. Furthermore, connected to head cap(s) there is or are vent tube(s) (not shown), the tip(s) of which is or are open to the atmosphere, and valve unit(s) (not shown) is or are disposed at intervening location(s) partway along such vent tube(s).

During the aforementioned cleaning, cap moving mechanism(s) seal such head cap(s) against image forming head 101, and waste ink pump(s) is or are driven, causing suction of ink. Following suction, head cap(s) is or are maintained in sealed state(s) against image forming head 101 so as to protect jet orifice(s) 101*a* at tip(s) of waste ink tube(s) 101*b* extending from image forming head 101 from coagulation (drying) of ink or accumulation of dust. Furthermore, during flushing, head cap(s) is or are backed off from image forming head 101 so as to produce clearance therebetween, and while still in the state, ink is caused to be jetted toward head cap(s) from image forming head 101.

The foregoing head cap(s) is or are constituted such that ink absorbing material and cap gasket(s) are housed within cap case(s), not shown, which is or are situated in opposing fashion with respect to image forming head 101 and wherein opening(s) is or are formed. Cap gasket(s) is or are of sufficient size to encompass jet orifice(s) 101*a* of image forming head 101, gap(s) between image forming head 101 and cap case(s) being sealed when edge(s) of cap gasket(s) is or are pressed against image forming head 101.

The foregoing ink pump(s) rotate so as to squeeze waste ink tube(s) 101*b* in undulating fashion, causing waste ink to be sucked from where it is present within head cap(s). Such suction may take the form of suction proper such as is performed during cleaning, or dry suction which simply refers to suction of waste ink which has accumulated at head cap(s). Whereas valve unit(s) is or are actuated so as to cause vent tube(s) to be closed off in order to suck ink from image forming head 101 during suction proper, valve unit(s) is or are actuated so as to cause vent tube(s) to be opened during dry suction.

Figure 4:
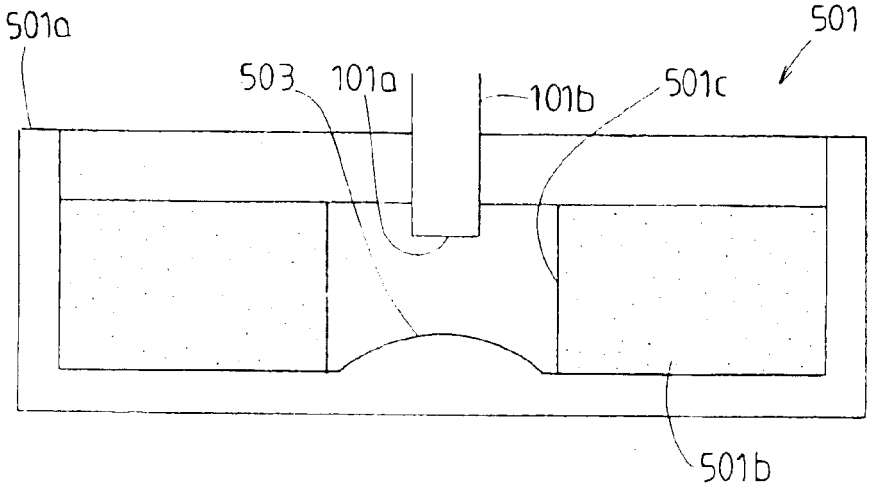
FIG. 4 is a vertical sectional view of a waste ink storage component therein.

In addition, characteristic of the present invention is the fact that, as shown in FIG. 4, the foregoing waste ink storage component(s) 501 is or are equipped with waste ink container(s) 501*a* having bottom(s) capable of receiving waste ink dripping from jet orifice(s) 101*a* by way of waste ink tube(s) 101*b* from image forming head(s) 101, and waste ink absorption pad(s) 501*b* capable of absorbing and storing waste ink received by bottom(s) of such waste ink container (s) 501*a*. Provided at region(s) where waste ink drips onto bottom(s) of the foregoing waste ink container(s) 501*a* is or are boss(es) 503 of arcuate cross-section resembling portion (s) of sphere(s) made to protrude from such bottom(s). The foregoing waste ink container(s) 501*a*, being square container(s) made from resin which is or are open at the top, have capacity or capacities sufficient to permit storage of waste ink in amount(s) corresponding to the useful life of color inkjet printer 1. Furthermore, waste ink absorption pad(s) 501*b*, provided over bottom(s) of waste ink container (s) 501*a*, is or are provided with through-hole(s) 501*c* permitting waste ink coming from jet orifice(s) 101*a* by way of waste ink tube(s) 101*b* to drip directly onto waste ink drip region(s) at bottom(s) of waste ink container(s) 501*a*. Inside diameter(s) of such through-hole(s) 501*c* is or are formed so as to be somewhat larger than outside diameter(s) of boss(es) 503 on bottom(s) of waste ink container(s) 501*a*, and is or are set so as to be greater than outside diameter(s) of waste ink tube(s) 101*b*. Moreover, tip(s) of waste ink tube(s) 101*b* (jet orifice(s) 101*a*) is or are located within through-hole(s) 501*c* in waste ink absorption pad(s) 501*b*. Here, waste ink absorption pad(s) 501*b* is or are disposed at location(s) preventing it or them from coming into direct contact with boss(es) 503 and preventing it or them from coming into direct contact with waste ink droplet(s) dripping onto boss (es) 503.

Accordingly, in the foregoing embodiment, waste ink dripping onto boss(es) 503 at bottom(s) of waste ink container(s) 501*a* from jet orifice(s) 101*a* at tip(s) of waste ink tube(s) 101*b* is, as it is dispersed in all directions at boss(es) 503, carried along surface(s) of boss(es) 503 and reaches bottom(s) (low point(s)) of waste ink container(s) 501*a*, allowing it to be absorbed in well-balanced fashion from area(s) surrounding through-hole(s) 501*c* in waste ink absorption pad(s) 501*b*. This therefore permits area over which initiation of absorption by waste ink absorption pad(s) 501*b* of waste ink from waste ink tube(s) 101*b* can occur to be made extremely large range due to presence of waste ink which reaches bottom(s) of waste ink container(s) 501*a* as it is dispersed in all directions at boss(es) 503, reducing the tendency for sticking of waste ink and blocking of fluid paths traveled by waste ink near original waste ink absorption center(s) to occur and making it possible for waste ink from waste ink tube(s) 101*b* to be efficiently absorbed by waste ink absorption pad(s) 501*b*. Moreover, because waste ink dripping onto boss(es) 503 and being dispersed in all directions is carried along surface(s) of boss(es) 503 to reach bottom(s) of waste ink container(s) 501*a*, waste ink does not splash as is the case where waste ink is made to collide with guide wall(s), and waste ink is definitively absorbed by waste ink absorption pad(s) 501*b*.

Furthermore, because cross-section(s) of boss(es) 503 is or are formed so as to be more or less arcuate in shape, boss(es) 503 is or are such that slope(s) of face(s) thereof grow steeper relative to bottom(s) of waste ink container(s) 501*a* with increasing proximity to the periphery or peripheries thereof, i.e., with increasing proximity to bottom(s) of waste ink container(s) 501*a*. Waste ink dripping onto boss (es) 503 therefore does not linger at sloped face(s) of boss(es) 503, but is carried along surface(s) of boss(es) 503 to reach bottom(s) of waste ink container(s) 501*a*, permitting waste ink to be definitively absorbed by waste ink absorption pad(s) 501*b*.

Moreover, because waste ink absorption pad(s) 501*b* is or are disposed at location(s) preventing it or them from coming into direct contact with boss(es) 503 and preventing it or them from coming into direct contact with waste ink droplet(s) dripping onto boss(es) 503 due to the fact that through-hole(s) 501*c* in waste ink absorption pad(s) 501*b* is or are formed such that inside diameter(s) thereof is or are somewhat larger than outside diameter(s) of boss(es) 503, boss(es) 503 do not contact waste ink absorption pad(s) 501*b*, and waste ink carried along boss(es) 503 and reaching bottom(s) of waste ink container(s) 501*a* diffuses toward area(s) surrounding through-hole(s) 501*c* in waste ink absorption pad(s) 501*b*, allowing waste ink to be absorbed by waste ink absorption pad(s) 501*b* in well-balanced fashion, waste ink not being absorbed with occurrence of bias(es) with respect to waste ink absorption pad(s) 501*b* as is the case where boss(es) contact waste ink absorption pad(s).

Moreover, because tip(s) of waste ink tube(s) 101*b* (jet orifice(s) 101*a*) is or are located within through-hole(s) 501*c* in waste ink absorption pad(s) 501*b*, even where bubble(s) produced when air drawn together with waste ink drawn from image forming head(s) 101 is discharged from end(s) of waste ink tube(s) 101*b* together with waste ink burst at jet orifice(s) 101*a* at tip(s) of waste ink tube(s) 101*b*, atomizing waste ink and spraying it about, waste ink spray is captured within through-hole(s) 501*c* in waste ink absorption pad(s) 501*b* and is absorbed by waste ink absorption pad(s) 501*b*, making it possible for waste ink to be definitively absorbed by waste ink absorption pad(s) 501*b* without dirtying surrounding area(s).

Second Embodiment

Figure 5:
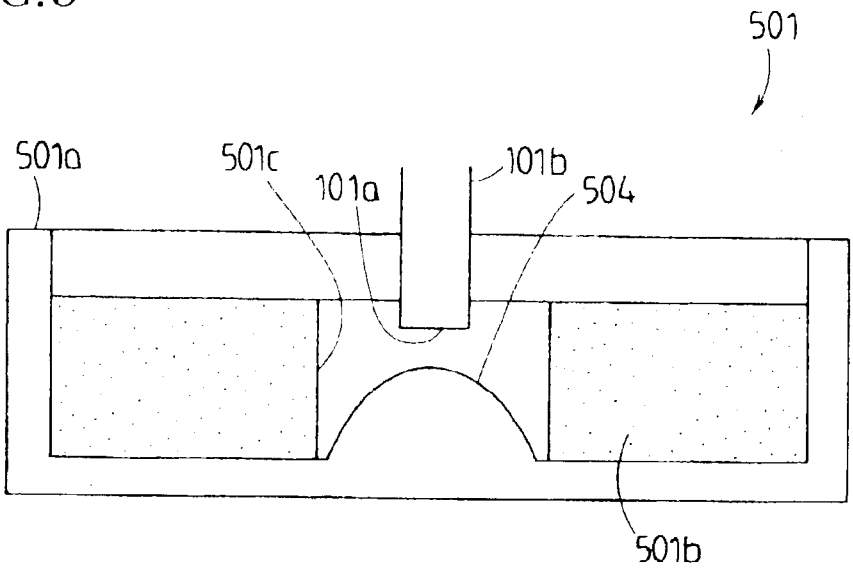
FIG. 5 is a vertical sectional view of a waste ink storage component in a color inkjet printer associated with a second embodiment of the present invention.

Next, referring to FIG. 5, a second embodiment of the present invention is described.

In the present embodiment, shape(s) of boss(es) is or are modified. Note that, except for the boss(es), the constitution is in other respects identical to that of the foregoing first embodiment, and like components will be assigned like reference numerals and detailed description thereof will be omitted.

That is, as shown in FIG. 5, in the present embodiment, provided at region(s) where waste ink drips onto bottom(s) of waste ink container(s) 501*a* is or are boss(es) 504 of more or less quadratic cross-section resembling tip(s) of spindles (s) made to protrude from such bottom(s).

In the present case, boss(es) 504 is or are such that slope(s) of face(s) thereof grow even steeper relative to bottom(s) of waste ink container(s) 501*a* with increasing proximity to the periphery or peripheries thereof, i.e., with increasing proximity to bottom(s) of waste ink container(s) 501*a*. Waste ink dripping onto boss(es) 504 therefore does not linger at sloped face(s) of boss(es) 504, but is carried along surface(s) of boss(es) 504 and quickly reaches bottom (s) of waste ink container(s) 501*a*, permitting waste ink to be definitively absorbed by waste ink absorption pad(s) 501*b* from area(s) surrounding through-hole(s) 501*c*.

Third Embodiment

Figure 6:
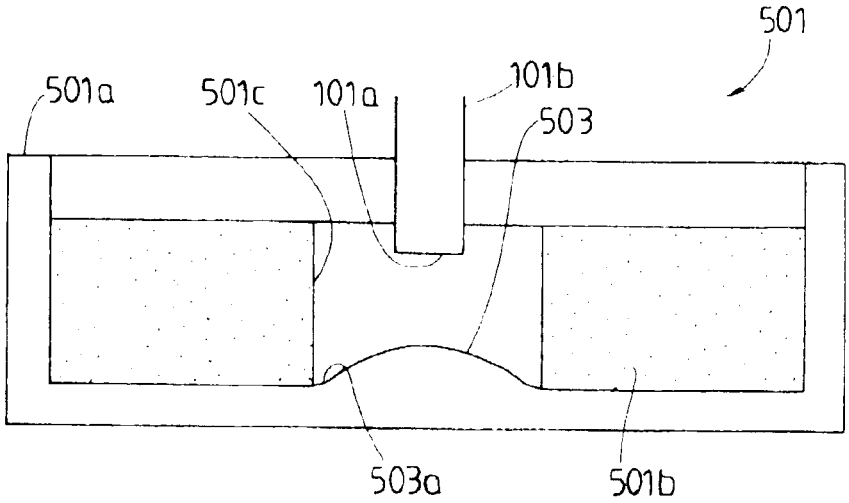
FIG. 6 is a vertical sectional view of a waste ink storage component in a color inkjet printer associated with a third embodiment of the present invention.

Next, referring to FIG. 6, a third embodiment of the present invention is described.

In the present embodiment, shape(s) of basal portion(s) of boss(es) is or are modified. Note that, except for the basal portion(s) of boss(es), the constitution is in other respects identical to that of the foregoing first embodiment, and like components will be assigned like reference numerals and detailed description thereof will be omitted.

That is, as shown in FIG. 6, in the present embodiment, boss(es) 503 protruding from waste ink drip region(s) at bottom(s) of waste ink container(s) 501*a* is or are made smoothly continuous with bottom(s) of waste ink container (s) 501*a* due to presence of arcuate curved surface(s) 503*a* provided at basal portion(s) thereof, i.e., at area(s) surrounding boss(es) 503.

In the present case, due to presence of curved surface(s) 503*a* at area(s) surrounding (i.e., at basal portion(s) of) boss(es) 503, waste ink carried along boss(es) 503 flows without lingering at area(s) surrounding boss(es) 503 as it diffuses toward area(s) surrounding through-hole(s) 501*c* in waste ink absorption pad(s) 501*b* from bottom(s) of waste ink container(s) 501*a*. This makes it possible for waste ink dripping from waste ink tube(s) 101*b* to be efficiently absorbed by waste ink absorption pad(s) 501*b*.

Fourth Embodiment

Figure 7:
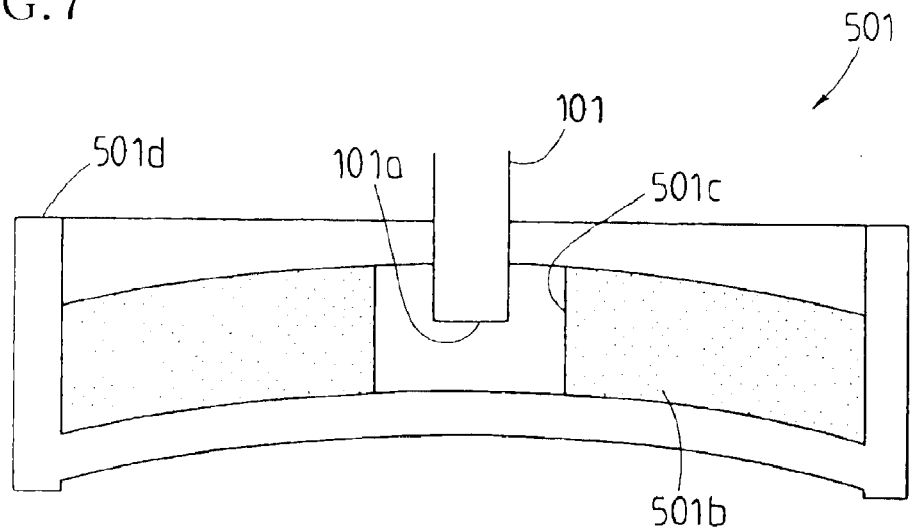
FIG. 7 is a vertical sectional view of a waste ink storage component in a color inkjet printer associated with a fourth embodiment of the present invention.

Next, referring to FIG. 7, a fourth embodiment of the present invention is described.

In the present embodiment, shape(s) of bottom(s) of waste ink container(s) is or are modified. Note that, except for the shape(s) of bottom(s) of waste ink container(s), the constitution is in other respects identical to that of the foregoing first embodiment, and like components will be assigned like reference numerals and detailed description thereof will be omitted.

That is, as shown in FIG. 7, in the present embodiment, bottom(s) of waste ink container(s) 501*d* is or are formed in shape(s) of curved surface(s) of constant curvature(s) so as to be convex as viewed from above. In addition, region(s) occupied by such curved surface(s) of bottom(s) of waste ink container(s) 501*d* is or are set so as to be larger than through-hole(s) 501*c* in waste ink absorption pad(s) 501*b*.

In such case, it will be possible for waste ink dripping onto bottom(s) of waste ink container(s) 501*d* from end(s) of waste ink tube(s) 101*b* to, as it follows shape(s) of curved surface(s) of bottom(s) and is diffused after being dispersed in all directions, be absorbed in well-balanced fashion from area(s) surrounding through-hole(s) 501*c* in waste ink absorption pad(s) 501*b* and, due to shape(s) of curved surface(s) of bottom(s), to not accumulate at area(s) surrounding through-hole(s) 501*c* in waste ink absorption pad (s) 501*b* but to propagate to peripheral end(s) of waste ink absorption pad(s) 501*b*, increasing efficiency with which waste ink is absorbed by waste ink absorption pad(s) 501*b*.

Fifth Embodiment

Figure 8:
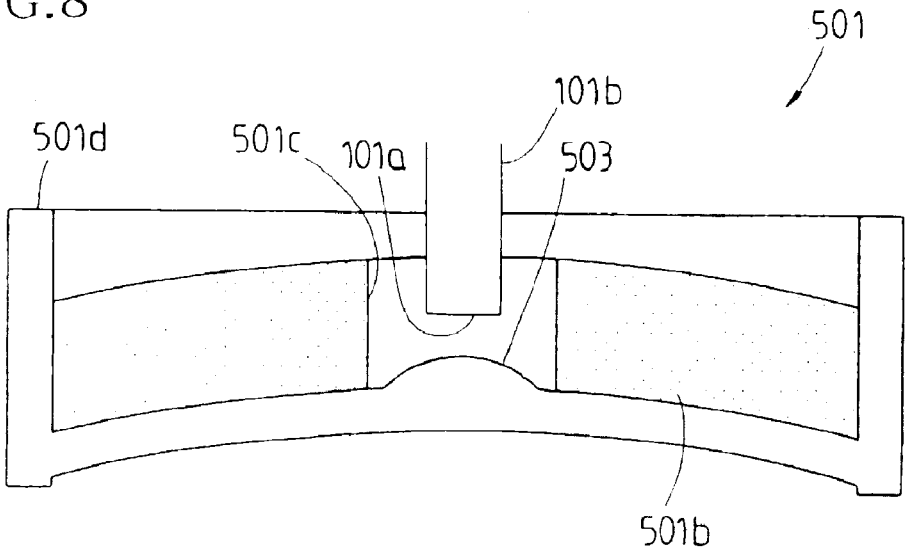
FIG. 8 is a vertical sectional view of a waste ink storage component in a color inkjet printer associated with a fifth embodiment of the present invention.

Next, referring to FIG. 8, a fifth embodiment of the present invention is described.

In the present embodiment, shape(s) of bottom(s) of waste ink container(s) having boss(es) is or are modified. Note that, except for the shape(s) of bottom(s) of waste ink container(s), the constitution is in other respects identical to that of the foregoing first embodiment, and like components will be assigned like reference numerals and detailed description thereof will be omitted.

That is, as shown in FIG. 8, in the present embodiment, bottom(s) of waste ink container(s) 501*d* is or are formed in shape(s) of curved surface(s) of constant curvature(s) so as to be convex as viewed from above. In addition, region(s) occupied by such curved surface(s) of bottom(s) of waste ink container(s) 501*d* is or are set so as to be larger than through-hole(s) 501*c* in waste ink absorption pad(s) 501*b*. Furthermore, inside diameter(s) of through-hole(s) 501*c* in waste ink absorption pad(s) 501*b* is or are formed so as to be somewhat larger than outside diameter(s) of boss(es) 503 protruding from waste ink drip region(s) at bottom(s) of waste ink container(s) 501*d*.

In such case, waste ink dripping onto boss(es) 503 at bottom(s) of waste ink container(s) 501*d* from end(s) of waste ink tube(s) 101*b* does not linger at sloped face(s) of boss(es) 503, but is carried along surface(s) of boss(es) 503 to reach bottom(s) of waste ink container(s) 501*d*, whereupon it follows the shape(s) of such bottom(s) and is proactively diffused toward peripheral end(s) of waste ink absorption pad(s) 501*b*, permitting waste ink to be efficiently absorbed from area(s) surrounding through-hole(s) 501*c* in waste ink absorption pad(s) 501*b*, and moreover, propagation of waste ink absorbed from area(s) surrounding through-hole(s) 501*c* in waste ink absorption pad(s) 501*b* to peripheral end(s) of waste ink absorption pad(s) 501*b* is facilitated, permitting increase in efficiency with which waste ink is absorbed by waste ink absorption pad(s) 501*b*.

Sixth Embodiment

Figure 9:
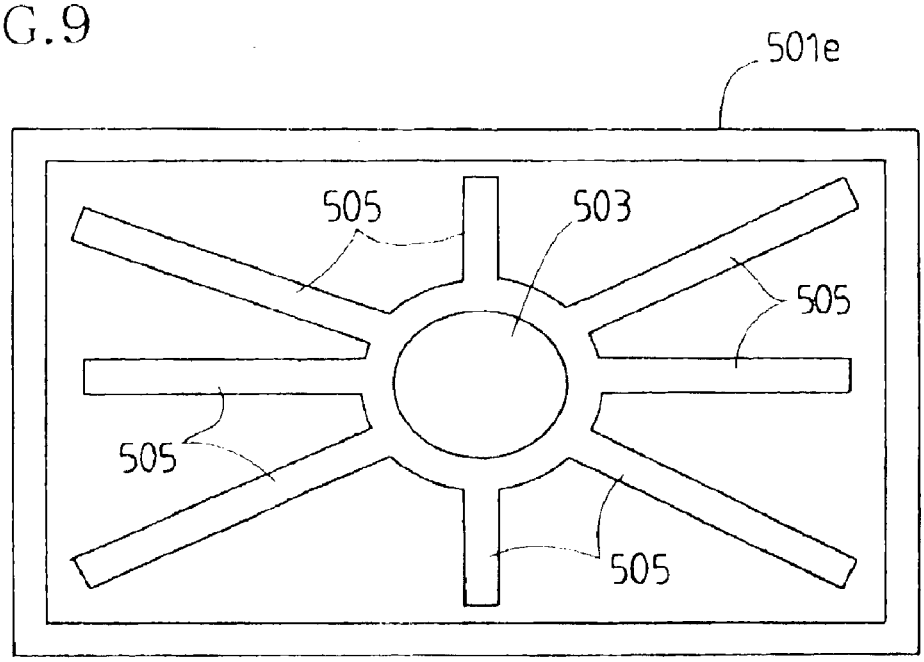
FIG. 9 is a plan view, shown as viewed from above, of a waste ink container in a color inkjet printer associated with a sixth embodiment of the present invention.
Figure 10:
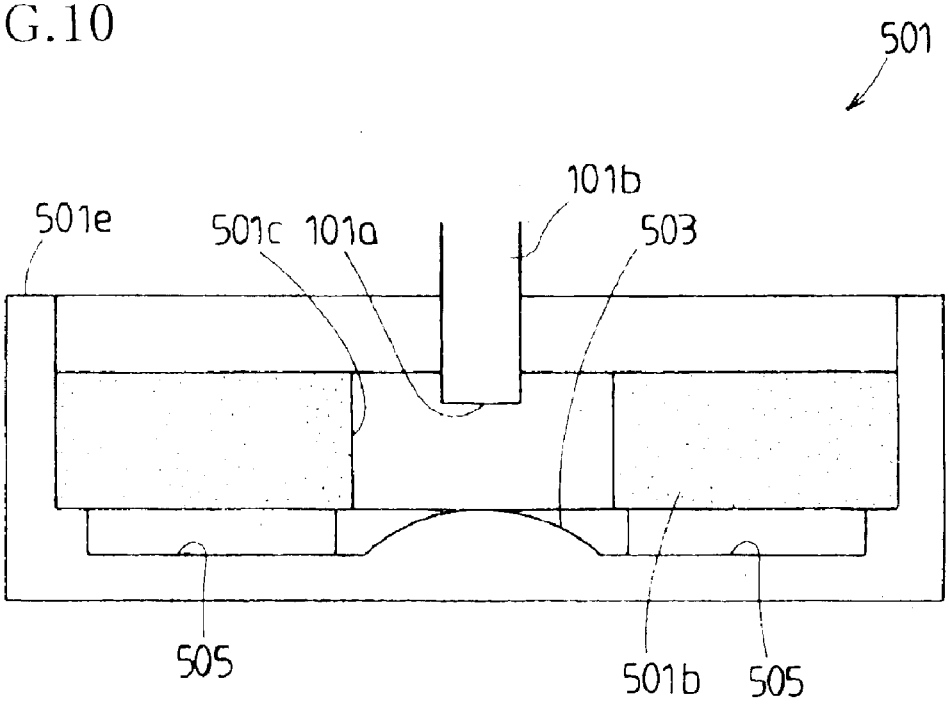
FIG. 10 is a vertical sectional view of a color inkjet printer waste ink storage component therein.

Next, referring to FIGS. 9 and 10, a sixth embodiment of the present invention is described.

In the present embodiment, shape(s) of bottom(s) of waste ink container(s) is or are modified. Note that, except for the shape(s) of bottom(s) of waste ink container(s), the constitution is in other respects identical to that of the foregoing first embodiment, and like components will be assigned like reference numerals and detailed description thereof will be omitted.

That is, as shown in FIGS. 9 and 10, in the present embodiment, provided at bottom(s) of waste ink container(s) 501*e* are a plurality of channels 505, . . . extending radially from central location(s) occupied by boss(es) 503 onto which waste ink drips. Each such channel 505 extends radially to a point short of the outer rim of the bottom of waste ink container 501*e*, the distal end thereof (outer end in the radial direction) being located inward radially from the outer circumferential edge of waste ink absorption pad 501*b*.

In such case, waste ink dripping onto boss(es) 503 of waste ink container(s) 501*e* and dispersed in all directions is carried along respective channel(s) 505, . . . and is diffused, surface tension at vertical face(s) of respective channel(s) 505 causing absorption by waste ink absorption pad(s) 501*b* to occur over a domain which is large in size. In this way, distribution of absorption location(s) on waste ink absorption pad(s) 501*b* occurs in definitive fashion due to presence of waste ink which is carried along respective channel(s) 505 and is diffused, making it possible for waste ink to be absorbed by waste ink absorption pad(s) 501*b* in still more well-balanced fashion. Moreover, because distal end(s) of respective channel(s) 505 is or are located inward radially from the outer circumferential edge of waste ink absorption pad 501*b*, waste ink carried along respective channel(s) 505 and guided to distal end(s) thereof can, due to surface tension at vertical face(s) located to the outside in the radial direction of respective channel(s) 505, be efficiently absorbed from locations at both the inside and the outside in the radial direction relative to the outer circumferential edge of waste ink absorption pad 501*b*, permitting increase in efficiency with which waste ink is absorbed by waste ink absorption pad 501*b*.

Seventh Embodiment

Figure 11:
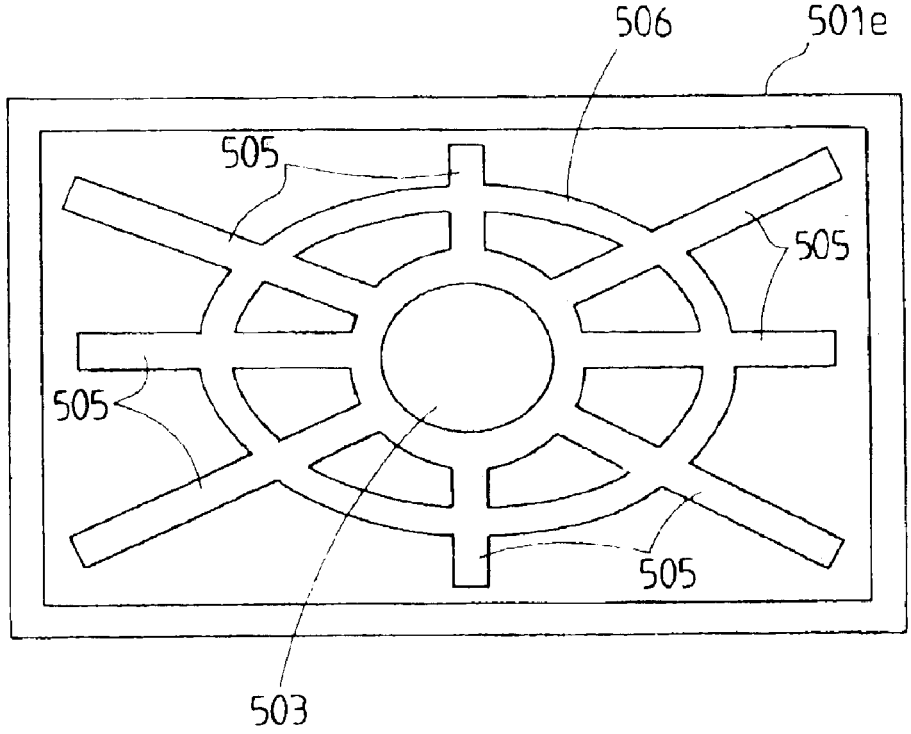
FIG. 11 is a plan view, shown as viewed from above, of a waste ink container in a color inkjet printer associated with a seventh embodiment of the present invention.
Figure 12:
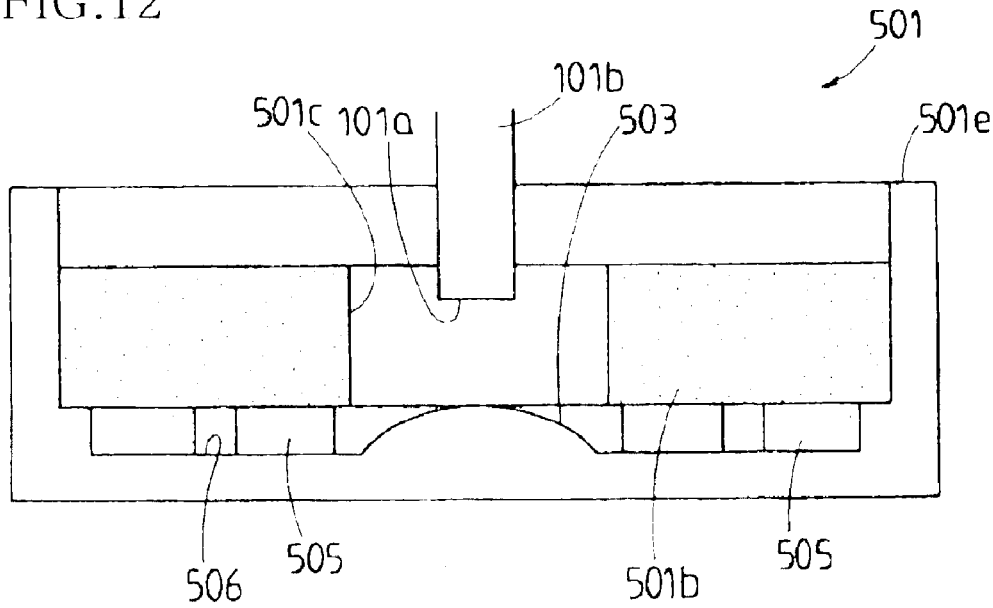
FIG. 12 is a vertical sectional view of a color inkjet printer waste ink storage component therein.

Next, referring to FIGS. 11 and 12, a seventh embodiment of the present invention is described.

In the present embodiment, shape(s) of bottom(s) of waste ink container(s) is or are modified. Note that, except for the shape(s) of bottom(s) of waste ink container(s), the constitution is in other respects identical to that of the foregoing first embodiment, and like components will be assigned like reference numerals and detailed description thereof will be omitted.

That is, as shown in FIGS. 11 and 12, in the present embodiment, provided at bottom(s) of waste ink container(s) 501*e* is or are more or less track-like circumferential channel (s) 506 making mutually continuous, in circumferential direction(s) thereabout, a plurality of channels 505, . . . extending radially from central location(s) occupied by boss(es) 503 onto which waste ink drips.

In such case, even in the unlikely event that waste ink which is being carried along respective channel(s) 505 and is being diffused were to solidify while traveling through a channel 505, new waste ink carried along that channel 505 and being diffused thereto would be carried along circumferential channel(s) 506 and be guided to neighboring channel(s) 505, this making it possible to maintain the efficiency with which waste ink is absorbed by waste ink absorption pad(s) 501*b* in versatile fashion.

Eighth Embodiment

Figure 13:
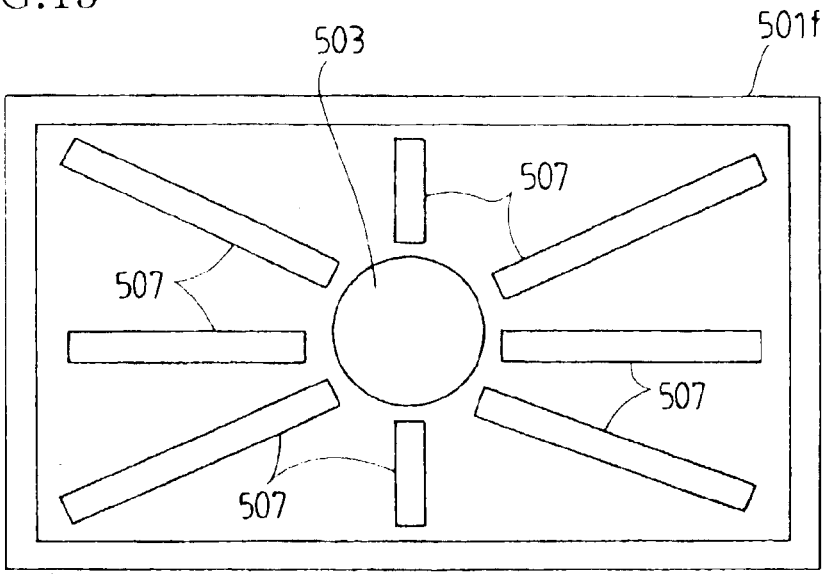
FIG. 13 is a plan view, shown as viewed from above, of a waste ink container in a color inkjet printer associated with an eighth embodiment of the present invention.
Figure 14:
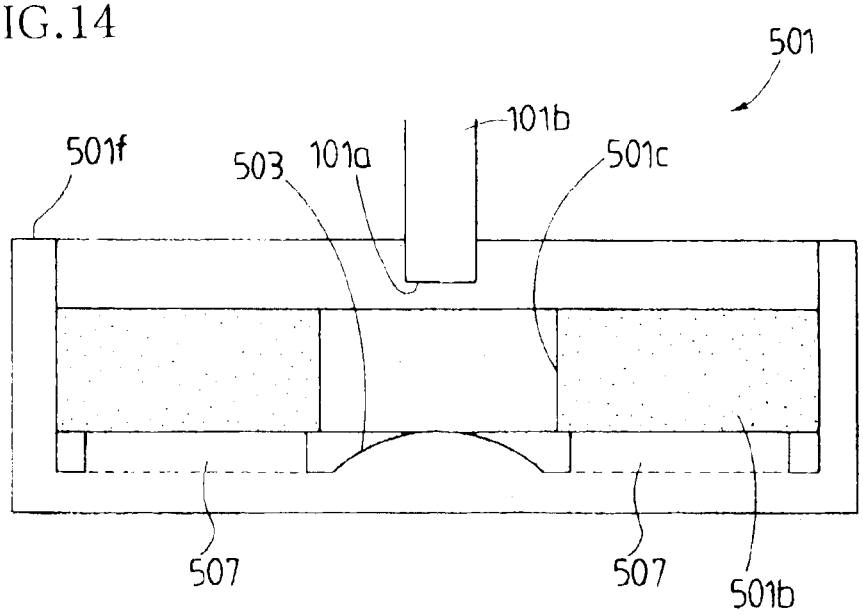
FIG. 14 is a vertical sectional view of a color inkjet printer waste ink storage component therein.

Next, referring to FIGS. 13 and 14, an eighth embodiment of the present invention is described.

In the present embodiment, shape(s) of bottom(s) of waste ink container(s) is or are modified. Note that, except for the shape(s) of bottom(s) of waste ink container(s), the constitution is in other respects identical to that of the foregoing first embodiment, and like components will be assigned like reference numerals and detailed description thereof will be omitted.

That is, as shown in FIGS. 13 and 14, in the present embodiment, provided at bottom(s) of waste ink container(s) 501*f* are a plurality of ribs 507, . . . extending radially from central location(s) occupied by boss(es) 503 onto which waste ink drips. In addition, waste ink absorption pad 501*b* is provided over plurality of ribs 507, . . . . Each such rib 507 extends radially to a point short of the outer rim of the bottom of waste ink container 501*f*, the distal end thereof (outer end in the radial direction) being located inward radially from (i.e., proximal with respect to) the outer circumferential edge of waste ink absorption pad 501*b*. Furthermore, tip(s) of waste ink tube(s) 101*b* (jet orifice(s) 101*a*) is or are located upward from through-hole(s) 501*c* in waste ink absorption pad(s) 501*b*.

In such case, waste ink dripping onto boss(es) 503 of waste ink container(s) 501*f* and dispersed in all directions is carried along vertical face(s) of respective rib(s) 507, . . . and is diffused, surface tension at vertical face(s) of respective rib(s) 507 causing absorption by waste ink absorption pad(s) 501*b* to occur over a domain which is large in size. In this way, distribution of absorption location(s) on waste ink absorption pad(s) 501*b* occurs in definitive fashion due to presence of waste ink which is carried along vertical face(s) of respective rib(s) 507 and is diffused, making it possible for waste ink to be absorbed by waste ink absorption pad(s) 501*b* in still more well-balanced fashion. Moreover, because distal end(s) of respective rib(s) 507 is or are located inward radially from the outer circumferential edge of waste ink absorption pad 501*b*, waste ink carried along respective rib(s) 507 and guided to distal end(s) thereof can, due to surface tension at vertical face(s) located to the outside in the radial direction of respective rib(s) 507, be efficiently absorbed from locations at both the inside and the outside in the radial direction relative to the outer circumferential edge of waste ink absorption pad 501*b*, permitting increase in efficiency with which waste ink is absorbed by waste ink absorption pad 501*b*. Moreover, because tip(s) of waste ink tube(s) 101*b* is or are located upward from through-hole(s) 501*c* in waste ink absorption pad(s) 501*b*, even where bubble(s) produced when air drawn together with waste ink drawn from image forming head(s) 101 is discharged from end(s) of waste ink tube(s) 101*b* together with waste ink burst at jet orifice(s) 101*a* at tip(s) of waste ink tube(s) 101*b*, atomizing waste ink and spraying it about, waste ink spray is captured at area(s) surrounding through-hole(s) 501*c*, i.e., at top(s) of waste ink absorption pad(s) 501*b* and is absorbed from top(s) of waste ink absorption pad(s) 501*b*, making it possible for waste ink to be definitively absorbed by waste ink absorption pad(s) 501*b* efficiently and without dirtying surrounding area(s).

Ninth Embodiment

Figure 15:
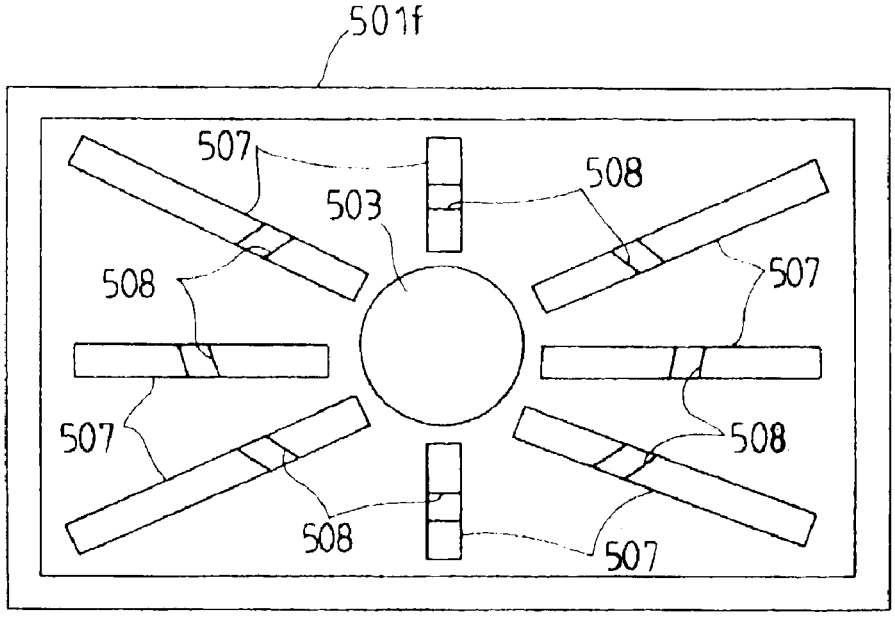
FIG. 15 is a plan view, shown as viewed from above, of a waste ink container in a color inkjet printer associated with a ninth embodiment of the present invention.
Figure 16:
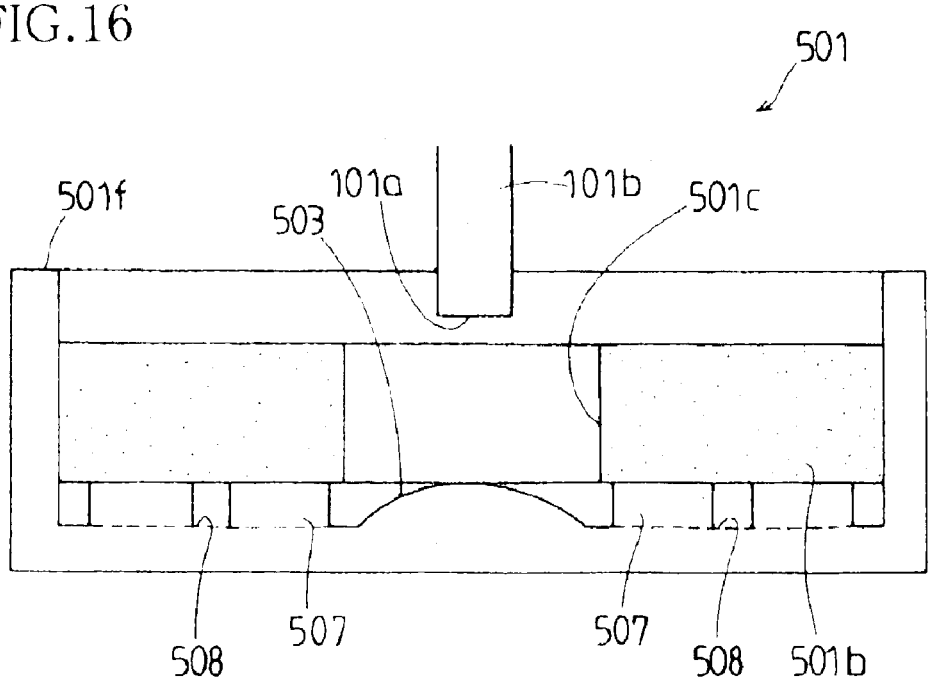
FIG. 16 is a vertical sectional view of a color inkjet printer waste ink storage component therein.

Next, referring to FIGS. 15 and 16, a ninth embodiment of the present invention is described.

In the present embodiment, shape(s) of bottom(s) of waste ink container(s) is or are modified. Note that, except for the shape(s) of bottom(s) of waste ink container(s), the constitution is in other respects identical to that of the foregoing first embodiment, and like components will be assigned like reference numerals and detailed description thereof will be omitted.

That is, as shown in FIGS. 15 and 16, in the present embodiment, provided at bottom(s) of waste ink container(s) 501*f* is or are more or less track-like circumferential channel (s) 508 passing through, in circumferential direction(s), a plurality of ribs 507, . . . extending radially from central location(s) occupied by boss(es) 503 onto which waste ink drips.

In such case, even in the unlikely event that waste ink which is being carried along vertical face(s) of respective rib(s) 507, . . . and is being diffused were to solidify while traveling along a vertical face, new waste ink carried along that vertical face and being diffused thereto would be carried along circumferential channel(s) 508 and be guided to vertical face(s) of neighboring rib(s) 507, this making it possible to maintain the efficiency with which waste ink is absorbed by waste ink absorption pad(s) 501*b* in versatile fashion.

Moreover, the present invention encompassing a wide variety of variations in addition thereto, the present invention is not to be limited by the respective foregoing embodiments. For example, whereas boss(es) 503 of arcuate cross-section resembling portion(s) of sphere(s) made to protrude from bottom(s) and boss(es) 504 of more or less quadratic cross-section resembling tip(s) of spindles(s) made to protrude from bottom(s) were provided at waste ink drip region(s) at bottom(s) of waste ink container(s) 501*a* in the foregoing first through third embodiments and at the fifth through ninth embodiments, conical boss(es) and/or pyramidal boss(es) may of course be employed as same.

The present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are moreover within the scope of the present invention.

Moreover, the present application claims right of benefit of prior filing date of Japanese Patent Application No. 2002-192306, the content of which is incorporated herein by reference in its entirety. Furthermore, all references cited in the present specification are specifically incorporated herein by reference in their entirety.

What is claimed is:

1. An ink jet printer waste ink storage apparatus comprising:

one or more waste ink containers, at least one of a bottom or bottoms of which is capable of receiving waste ink dripping by way of one or more waste ink tubes from one or more recording heads; and one or more waste ink absorption pads, at least one of which is capable of absorbing and storing at least a portion of the waste ink received by at least one of the bottom or bottoms of at least one of the waste ink container or containers, the ink jet printer waste ink storage apparatus provided with one or more bosses at one or more drip regions where at least a portion of the waste ink drips into at least one of the bottom or bottoms of at least one of the waste ink container or containers, and the at least one of the ink absorption pad or pads is disposed at a location preventing it from coming into direct contact with at least one of the boss or bosses and preventing it from coming into direct contact with the waste ink droplet or droplets dripping onto at least one of the boss or bosses.

2. An inkjet printer waste ink storage apparatus according to claim 1, wherein:

a cross-section of at least one of the boss or bosses is formed so as to be more or less arcuate in shape.

3. An inkjet printer waste ink storage apparatus according to claim 1, wherein:

at least one of the boss or bosses has at least one curved surface at, at least one basal portion thereof making it smoothly continuous with at least one of the bottom or bottoms of at least one of the waste ink container or containers.

4. An inkjet printer waste ink storage apparatus according to claim 1, wherein:

at least one of the waste ink absorption pad or pads is disposed over at least one of the bottom or bottoms of at least one of the waste ink container or containers, and is provided with one or more through-holes permitting waste ink to drip from at least one of the waste ink tube or tubes onto at least one of the bottom or bottoms of at least one of the waste ink container or containers; and the inside diameter of at least one of the through-hole or holes is greater than the outside diameter of at least one of the waste ink tube or tubes.

5. An inkjet printer waste ink storage apparatus according to claim 1, wherein:

at least one of the bottom or bottoms of at least one of the waste ink container or containers presents at least one curved surface which is convex as viewed from above.

6. An ink jet printer waste ink storage apparatus comprising:

one or more waste ink containers, at least one of a bottom or bottoms of which is capable of receiving waste ink dripping by way of one or more waste ink tubes from one or more recording heads; and one or more waste ink absorption pads, at least one of which is capable of absorbing and storing at least a portion of the waste ink received by at least one of the bottom or bottoms of at least one of the waste ink container or containers, at least one of the bottom or bottoms of at least one of the waste ink container or containers presents at least one curved surface which is convex as viewed from above;

at least one of the waste ink absorption pad or pads is provided with one or more through-holes permitting waste ink to drip from at least one of the waste ink tube or tubes onto at least one of the bottom or bottoms of at least one of the waste ink container or containers; and at least one region occupied by at least one of the curved surface or surfaces of at least one of the waste ink container bottom or bottoms is larger than at least one of the through-hole or holes in the waste ink absorption pad or pads.

7. An inkjet printer waste ink storage apparatus according to claim 1 or claim 6, wherein:

at least one of the bottom or bottoms of at least one of the waste ink container or containers is provided with one or more channels extending radially from one or more central locations onto which waste ink drips.

8. An inkjet printer waste ink storage apparatus according to claim 7, wherein:

at least one of the bottom or bottoms of at least one of the waste ink container or containers is provided with one or more circumferential channels making mutually continuous, in one or more circumferential directions around at least one of the central location or locations onto which waste ink drips, at least a portion of the channel or channels extending radially.

9. An inkjet printer waste ink storage apparatus according to claim 1 or claim 6, wherein:

at least one of the bottom or bottoms of at least one of the waste ink container or containers is provided with one or more ribs extending radially from one or more central locations onto which waste ink drips.

10. An inkjet printer waste ink storage apparatus according to claim 9, wherein:

at least one of the bottom or bottoms of at least one of the waste ink container or containers is provided with one or more circumferential channels passing through, in one or more circumferential directions around at least one of the central location or locations onto which waste ink drips, at least a portion of the rib or ribs extending radially.

11. An inkjet printer waste ink storage apparatus according to claim 1 or claim 6, wherein:

at least one tip of at least one of the waste ink tube or tubes is located within at least one of the through-hole or-holes in at least one of the waste ink absorption pad or pads.

12. An ink jet printer waste ink storage apparatus comprising:

one or more waste ink containers, at least one of a bottom or bottoms of which is capable of receiving waste ink dripping by way of one or more waste ink tubes from one or more recording heads; and one or more waste ink absorption pads, at least one of which is capable of absorbing and storing at least a portion of the waste ink received by at least one of the bottom or bottoms of at least one of the waste ink container or containers, the ink jet printer waste ink storage apparatus provided with one or more bosses at one or more drip regions where at least a portion of the waste ink drips into at least one of the bottom or bottoms of at least one of the waste ink container or containers, at least one of the bottom or bottoms of at least one of the waste ink container or containers is provided with one or more channels extending radially from one or more central locations onto which waste ink drips, at least one of the bottom or bottoms of at least one of the waste ink container or containers is provided with one or more circumferential channels making mutually continuous, in one or more circumferential directions round at least one of the central location or locations onto which waste ink drips, at least a portion of the channel or channels extending radially.

13. An ink jet printer waste ink storage apparatus comprising:

one or more waste ink containers, at least one of a bottom or bottoms of which is, capable of receiving waste ink dripping by way of one or more waste ink tubes from one or more recording heads; and one or more waste ink absorption pads, at least one of which is capable of absorbing and storing at least a portion of the waste ink received by at least one of the bottom or bottoms of at least one of the waste ink container or containers, the ink jet printer waste ink storage apparatus provided with one or more bosses at one or more drip regions where at least a portion of the waste ink drips into at least one of the bottom or bottoms of at least one of the waste ink container or containers, at least one of the bottom or bottoms of at least one of the waste ink container or containers is provided with one or more ribs extending radially from one or more central locations onto which waste ink drips, wherein at least one of the bottom or bottoms of at least one of the waste ink container or containers if provided with one or more circumferential channels passing through, in one or more circumferential directions around at least one of the central location or locations onto which waste ink drips, at least a portion of the rib or ribs extending radially.

* * * * *

UNITED STATES PATENT AND TRADEMARK OFFICE

CERTIFICATE OF CORRECTION

PATENT NO. : 6,890,057 B2
DATED : May 10, 2005
INVENTOR(S) : Takashi Gotoh et al.

It is certified that error appears in the above-identified patent and that said Letters Patent is hereby corrected as shown below:

Title page,
Item [30], Foreign Application Priority Data, change "Jul. 1, 2003" to -- Jul. 1, 2002 --.

Signed and Sealed this

Twenty-second Day of November, 2005

JON W. DUDAS
*Director of the United States Patent and Trademark Office*